US008844756B2

(12) United States Patent
Beyburg

(10) Patent No.: US 8,844,756 B2
(45) Date of Patent: Sep. 30, 2014

(54) PORTABLE CONSUMABLES ORGANIZER

(71) Applicant: 6 Pack Fitness, LLC, San Francisco, CA (US)

(72) Inventor: Michael Beyburg, San Francisco, CA (US)

(73) Assignee: 6 Pack Fitness, LLC, Francisco, CA (US)

( * ) Notice: Subject to any disclaimer, the term of this patent is extended or adjusted under 35 U.S.C. 154(b) by 0 days.

(21) Appl. No.: 13/632,024

(22) Filed: Sep. 30, 2012

(65) Prior Publication Data

US 2013/0119850 A1 May 16, 2013

Related U.S. Application Data

(63) Continuation-in-part of application No. 12/834,883, filed on Jul. 12, 2010.

(60) Provisional application No. 61/273,499, filed on Aug. 5, 2009.

(51) Int. Cl.

| | |
|---|---|
| ***B65D 81/38*** | (2006.01) |
| ***A47B 57/08*** | (2006.01) |
| ***A47B 88/04*** | (2006.01) |
| ***A47B 71/00*** | (2006.01) |
| ***A45F 3/46*** | (2006.01) |
| ***A47B 87/02*** | (2006.01) |
| *A45C 13/02* | (2006.01) |

(52) U.S. Cl.

CPC ..... *A47B 71/00* (2013.01); *A45C 2013/026* (2013.01); *A45C 13/02* (2013.01); *A47B 57/08* (2013.01); *A47B 88/04* (2013.01); *A45F 3/46* (2013.01); *F25D 2331/8011* (2013.01); *A47B 87/0253* (2013.01)

USPC ..... 220/592.2; 220/592.01

(58) Field of Classification Search

USPC ..... 62/441; 312/408, 348.3, 400; 211/113; 220/592.01, 592.2

See application file for complete search history.

(56) References Cited

U.S. PATENT DOCUMENTS

| | | | | |
|---|---|---|---|---|
| 4,295,432 | A * | 10/1981 | Hulke | 108/149 |
| 4,523,526 | A * | 6/1985 | O'Neill | 108/149 |
| 5,216,900 | A | 6/1993 | Jones | |
| 5,403,095 | A | 4/1995 | Melk | |
| 5,630,537 | A | 5/1997 | Sciacca | |
| 5,810,457 | A * | 9/1998 | Felsenthal et al. | 312/6 |
| 5,842,571 | A | 12/1998 | Rausch | |
| 6,435,390 | B1 * | 8/2002 | Abramowicz | 224/629 |
| 6,595,604 | B1 | 7/2003 | Peterson | |
| 6,612,434 | B1 | 9/2003 | Redzisz | |
| 6,688,470 | B2 * | 2/2004 | Dege et al. | 206/545 |
| 6,941,698 | B2 * | 9/2005 | Telles | 47/67 |
| 7,313,927 | B2 | 1/2008 | Barker | |
| 2002/0084206 | A1 | 7/2002 | Protopapas | |
| 2007/0272719 | A1 | 11/2007 | Laughton | |

* cited by examiner

*Primary Examiner* — Steven A. Reynolds
*Assistant Examiner* — Javier A Pagan
(74) *Attorney, Agent, or Firm* — Soody Tronson Law Group (STLGip), PC

(57) ABSTRACT

The present invention is generally related containers for storing and organizing consumable and non-consumable goods.

19 Claims, 12 Drawing Sheets

FIG. 7B
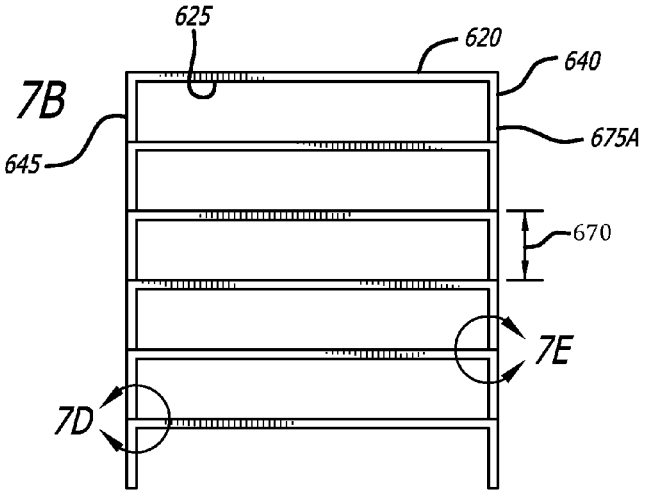
FIG. 7C
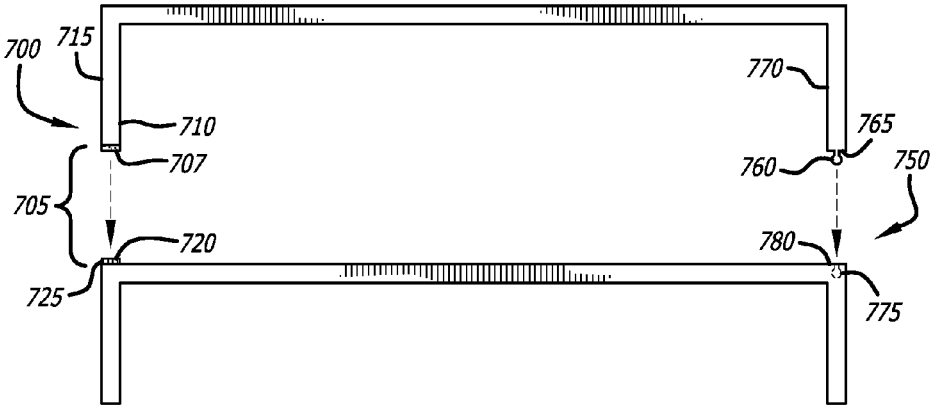
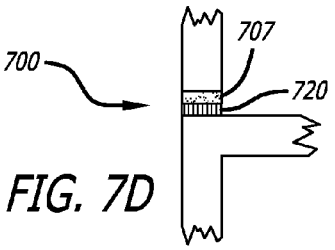
FIG. 7D
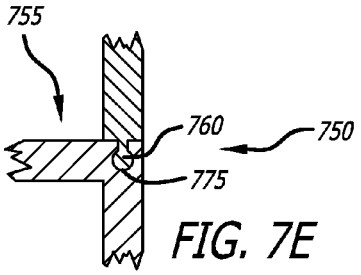
FIG. 7E

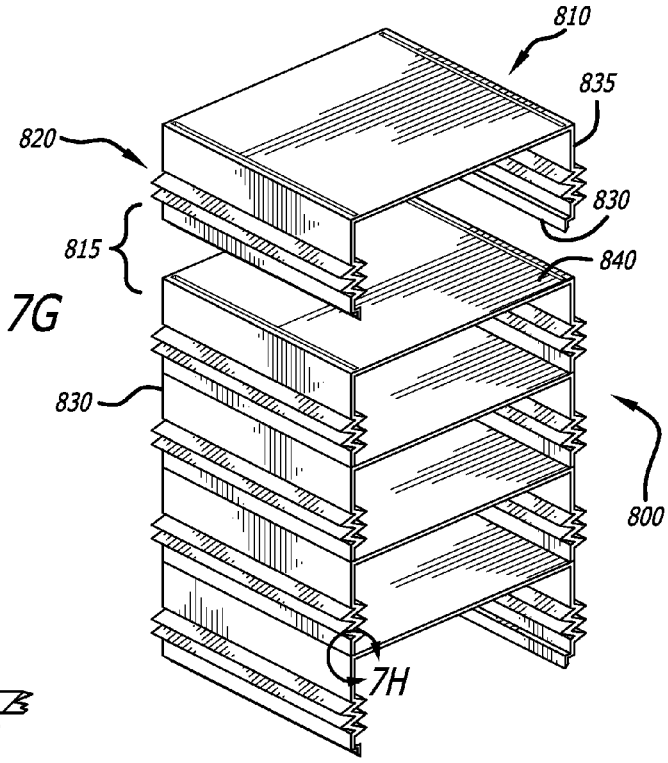
FIG. 7G
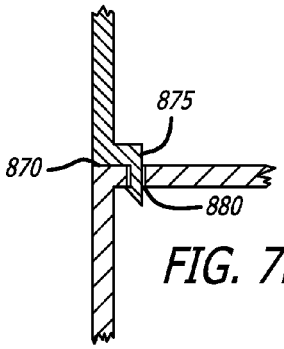
FIG. 7H
FIG. 7I
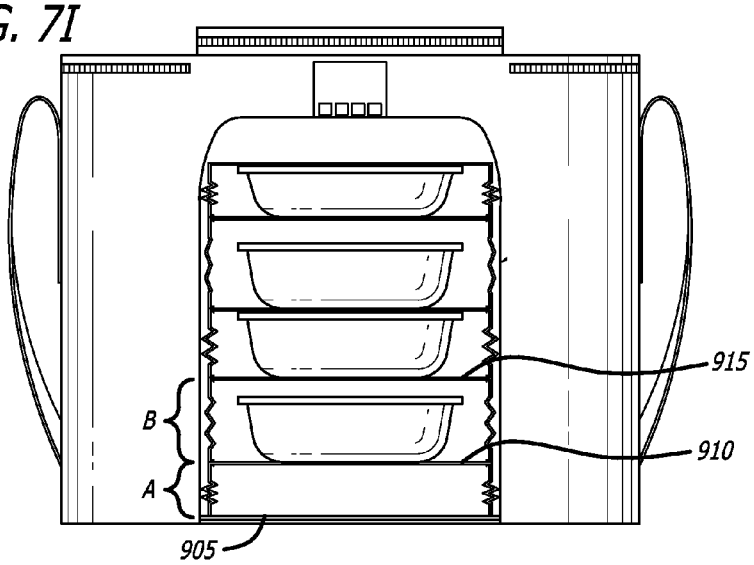

PORTABLE CONSUMABLES ORGANIZER

CROSS-REFERENCE TO RELATED APPLICATIONS

This application is a continuation-in-part of non-provisional U.S. patent application Ser. No. 12/834,883 filed Jul. 12, 2010 which claims priority to provisional U.S. patent application Ser. No. 61/273,499 filed Aug. 5, 2009; and assigned to the present assignee; and both of which applications are herein incorporated in their entirety.

FIELD OF THE INVENTION

The present invention is generally related to food and/or beverage containers, and more particularly to portable, insulated carriers useful for storing, conveying, and serving food, beverages, and the like.

BACKGROUND

In today's work and leisure world, which at times is combined into a single day, taking food and beverages and other necessities, have come a long way from the brown bag. During a given day, the user may need hot and cold food/beverages, as well as a host of other personal effects. Easily-portable lunch pails and small coolers (e.g., storage carriers) have become widely popular but are often susceptible to difficulties accessing the various items stored within the storage carrier which often leads to creating an unorganized compilation of items.

Despite a growing demand for more versatile, economical, and easily transportable storage carriers for consumable ingredients (e.g., food conveyances), most of such carriers result generally disorganized storage of random food/beverage items, as well as other randomly deposited personal effects.

SUMMARY OF THE INVENTION

The present invention is directed to portable assemblies and structures for storing objects, including consumable objects and personal effects (e.g., laptops, clothing). The present assemblies and structures enable independent access to stored items, including consumable containers. In an embodiment, the assemblies include a shelving design, which can accommodate storage containers of varying heights.

In an embodiment, an apparatus for removably storing objects comprises an open-faced structure having generally vertically-aligned side walls opposed to one another and a generally vertically-aligned back wall disposed between the opposed side walls; and a plurality of vertically-spaced-apart guide tracks formed within at least one side wall and extending from a front edge of the opposed side walls to the back wall, the guide tracks of the opposed walls extending substantially parallel to a corresponding guide track in the other opposed side wall and together forming a paired guide track, the paired guide track configured for securing a shelf thereon.

In an embodiment the apparatus may further include a top wall disposed on top of the opposed side walls and extending from the front edge of the opposed walls to the back wall. An insulating material may cover a top tray. The top tray may be removably positioned on an outer surface of the top wall or may be formed integral with the structure, wherein the top tray includes storage compartments. In an embodiment, the back wall may include at least one pair of horizontally spaced-apart-slits for engaging one or more notches extending vertically from the back edge of the shelf slidable in the paired guide track.

In an embodiments, at least some of the vertically-spaced-apart guide tracks comprise sufficient vertical dimension and a front edge to form a stop with a lip of a shelf slidably engaged therein, wherein the lip extends vertically from a front edge of the shelf. In an embodiments, opposed side walls may further include sidewall extensions extending outwardly from the front edge of the opposed side walls along a plane substantially vertical to a sidewall surface. The extension may have stop apertures for engaging with a lip of a shelf slidably engagable therein, wherein the lip extends vertically from a front edge of a shelf slidable in the paired guide track. Sidewall extensions may form a recessed space with the back wall for removably receiving temperature modification materials. In an embodiments, at least one harness strap may be coupled to an outer surface of the apparatus proximate with the back wall. In an embodiments, a pullout handle and at least two wheels may be used to transport the apparatus. A timer may also be disposed in an outer surface such as a cover of the apparatus.

In an embodiments, a shelving structure for removably storing objects therein may comprise a plurality of shelves stackable within the shelving structure, the shelving structure being, at least in part, surrounded by an insulating material, the shelving structure accommodating adjustable distances between adjacent shelves; and fasteners engageably disposed for securing the shelving structure to an interior wall of a shelving structure housing. In an embodiment, the shelving structure may further include one or more closure flap, e.g., zippered closure flaps formed in the insulating material to enable access to the shelving structure. The sealable closure flap aids in maintaining the temperature of the consumable items that may be stored in the structure. The closure flap may include a supplemental compartment, such as holder for temperature maintenance/modification element, e.g., an icepack, or other type of temperature modification element or device, mountable to or disposable against an inner surface of the flap. The supplemental compartment may be constructed of hard or soft plastic and may contain water, silicon, or other freezable material, or insulated material. The closure flap may be constructed of nylon, EVA molded, PVC insulation, and/or aluminum foil.

In an embodiment, the shelving structure is disposable inside a housing of a storage assembly. The storage assembly may include at least one side cavity adjacent the structure. In an embodiment, the structure includes a removable top tray coupled to the structure.

The tray may comprise compartments for holding a variety of objects, such as water bottles, protein bars, and protein drink shakers. The tray may be a stand-alone unit, may be integrally formed with the shelving system, and/or may be built into external or internal pockets of the storage assembly. In an embodiment, the storage assembly may include a compartment for storing clothing items such as towels, gym clothes, shoes, and so forth.

In an embodiment, an apparatus for storing objects, including consumable items, comprises means for thermally insulating the consumable items; means for removably housing a plurality of shelves into an internal structure of the apparatus, wherein the internal structure accommodates adjustable distances between adjacent shelves of the plurality of shelves. In an embodiment the apparatus includes means for accessing the consumable items from a top direction and/or from a front direction. The apparatus may also include means for storing consumable items within one or more compartments adjacent to the means for removably inserting the shelves.

In an embodiment, a storage assembly may include housing for housing shelves made from plastic, PVC, PET e.g., corrugated, rubber, aluminum, metal; and which allows for accessing a storage container without disturbing other storage containers stored within the storage structure. Shelves may be constructed from hard plastic and may be stackable in a shelving system. Shelves may be fastened to an inner wall of the housing of the storage assembly using Velcro® or other type of hook and loop system. In an embodiment, a slotting system may be used to hold shelves in place. Shelving guides may be constructed from molded plastic panels to hold shelves in place. In an embodiment, mesh, plastic panel, and Velcro may assist in forming an accordion-like shelving system in which shelf heights may be modulated to accommodate containers of varying heights.

The assemblies and structures embodying features of the present invention, include any one or more of the following features, alone or in combination with one another:

Front loading accessible flap and or door which may be accessible via a zipper or other fastening elements: the door (or flap) including cool/hot insulation material; Icepack (or hotpack) holder which can be constructed into the inner side of the door; Supplement compartment which can be formed into the inner side of the door; Supplement compartment holder which can be built into the door; Door may be made from nylon, EVA molded, zippers, PVC insulation, aluminum foil, and the like.

Independently accessible system: Front door or flap allowing at least substantially unobstructed access to the main storage compartment; The main storage compartment may include built in shelves that are made from plastic, PVC, PETG, corrugate, rubber, aluminum, metal or other suitable material that allow for independent accessibility to storage containers; the shelving system can be fabricated from: hard plastic; stacking modular shelves creating a shelving system; fastening means for securing the shelves to the main storage compartment using Velcro or other hook and loop systems; slotting and guide-rails system to hold the shelves in place; molded panels (e.g., EVA) to hold the shelves in place; mesh and/or plastic panel and Velcro (or the like) to create a collapsible accordion like shelving system.

Modular shelving system: Allowing the shelves to modulated allowing for accommodation of storage containers of various sizes.

Supplement Tray: Tray is comprised of customizable compartments that can hold supplements, nutritional bars; the supplement tray can be a stand alone unit, part of the shelving system, and/or built into the external/internal pockets of the storage assembly.

Specialized organizational compartments: External and internal compartments that can hold water bottles, protein storage containers and protein shakers of various sizes; laptop and books; clothing compartment for clothing and shoes Ice (or hot) Pack Compartment: Specially designated space for cooling apparatuses; compartments can be external or internal; Material can be nylon, PETG or mesh implemented to hold cooling apparatuses; Cooling apparatus may be formed from hard or soft plastic material in shaped into suitable form (e.g., containers) that may contain water, silicon, plastic or other freezable material.

Hybrid multi functional bag: By bringing together the functionality of meal management, clothing carrying capabilities, specially patted compartment for laptop/electronics and accessories, the bag becomes a unique multi function cooler.

The above and other features of the present invention, which will become more apparent as the description proceeds, are best understood by considering the following Detailed Description in conjunction with the accompanying drawings, wherein like characters represent like parts throughout the several views.

BRIEF DESCRIPTION OF THE DRAWINGS

Non-limiting and non-exhaustive features of the present invention are described with reference to the following figures, wherein like reference numerals refer to like parts throughout the various figures.

FIG. 7B is a front elevation view of stackable shelves of the assembly in FIG. 7A, in a fully stacked configuration.

FIG. 7C is front elevation view of two stackable shelves of FIG. 7B being removably secured to one another.

FIG. 7D is an enlarged side view of an embodiment of stackable shelves of FIG. 7B being removably secured to one another by way fasteners such as Velcro design.

FIG. 7E is an enlarged partially cut away side view of an embodiment of stackable shelves of FIG. 7B being removably secured to one another by way of a snap and fit design.

FIG. 7G is side perspective view of a structure for use in a storage assembly embodying features of the present invention having an adjustable height shelf design.

FIG. 7H is an enlarged cut away side view of an embodiment of the shelves of FIG. 7G being removably secured to one another by way fasteners such as snap and fit.

FIG. 7I is front partially cut away view of a storage assembly embodying features of the present invention and including the adjustable height shelf design of FIG. 7G, showing the shelves at different heights.

DESCRIPTION OF THE DRAWINGS

Figure 1A:
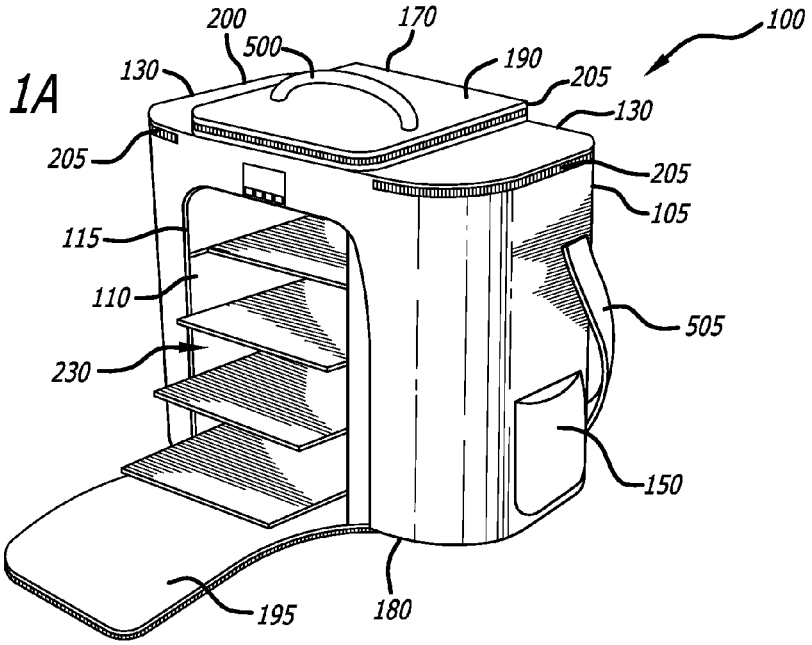
FIG. 1A is a top, front perspective view of a storage assembly embodying features of the present invention.
Figure 1B:
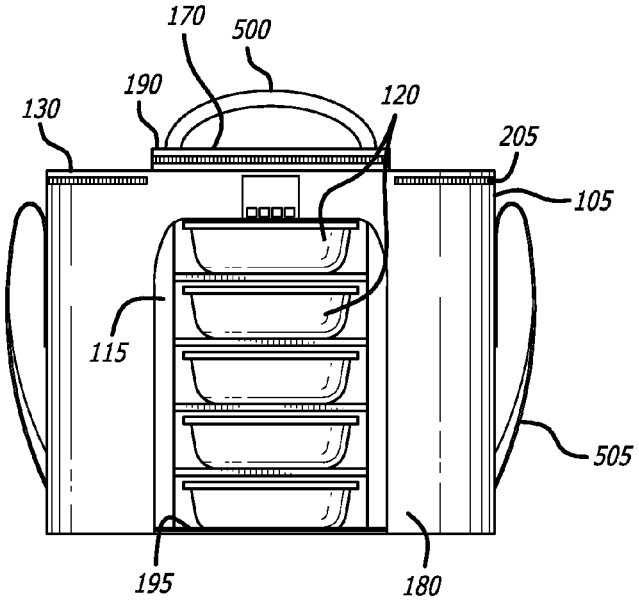
FIG. 1B is a front elevation view of the assembly of FIG. 1A shown open to illustrate exemplary storage of sample food containers stored therein.

Despite the advances in storage carriers for consumable ingredients, there is room for further improvement in providing carriers with enhanced organizational structure, accessibility to stored items, and storage of more diverse type of consumables and personal effects. The present invention is directed to improved carriers for consumable items which permit independent accessibility to one or more food storage containers storable in the carrier. In an embodiment, the carrier includes a front flap or panel or door enabling, at least substantially, unobstructed access to an inner housing or a main storage compartment of the carrier. Features of a exemplary assemblies and structures for storing and transporting consumables and other objects will be explained in reference to the following figures. It should be noted that either or both process and apparatus elements may be intended when referring to the following figures.

FIGS. 1A-1B and 5A-5B show a portable storage assembly 100 including features of the present invention, for storing and transporting consumables and other items. The storage assembly is configured to provide independent access to one or more of the items stored therein, including food storage containers. The storage assembly 100 generally includes an outer shell 105, an inner cavity 110 for receiving a shelving structure 115. Shelving structure 115 is configured for removably receiving one or more containers or objects 120. In an embodiment, as shown, the assembly 100 further includes at least one side compartment 130 (two as shown) disposed adjacent the inner cavity 110 and having side cavities 135 (see FIG. 2A) for placement of additional items such as beverage containers, fruit, utensils, napkins, hand wipes, bulk protein powder containers, and the like. In an embodiment, one or more of the various compartments may be padded to allow storage of laptops and other electronic devices. The outer shell 105 of the assembly 100 may be formed from hard, soft, or flexible material; and, at least in some implementations is constructed of a durable material. In an embodiment, the material forming the outer shell is fabricated with a thermally insulating padded material.

Figure 2A:
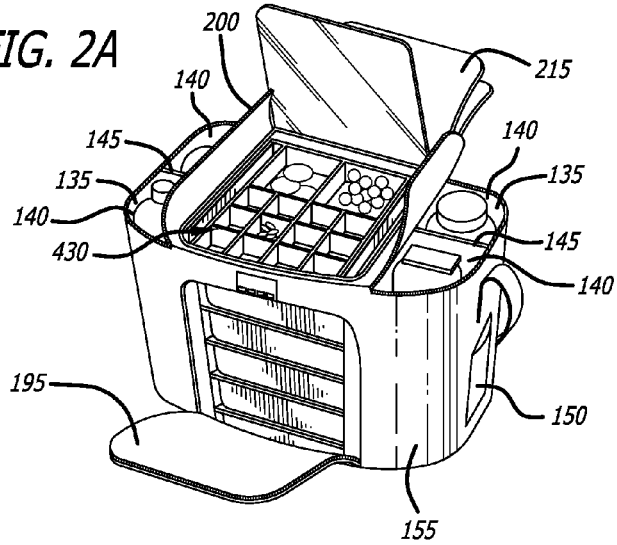
FIG. 2A is a top, front perspective view of a storage assembly embodying features of the present invention, with compartments fully charged.
Figure 2B:
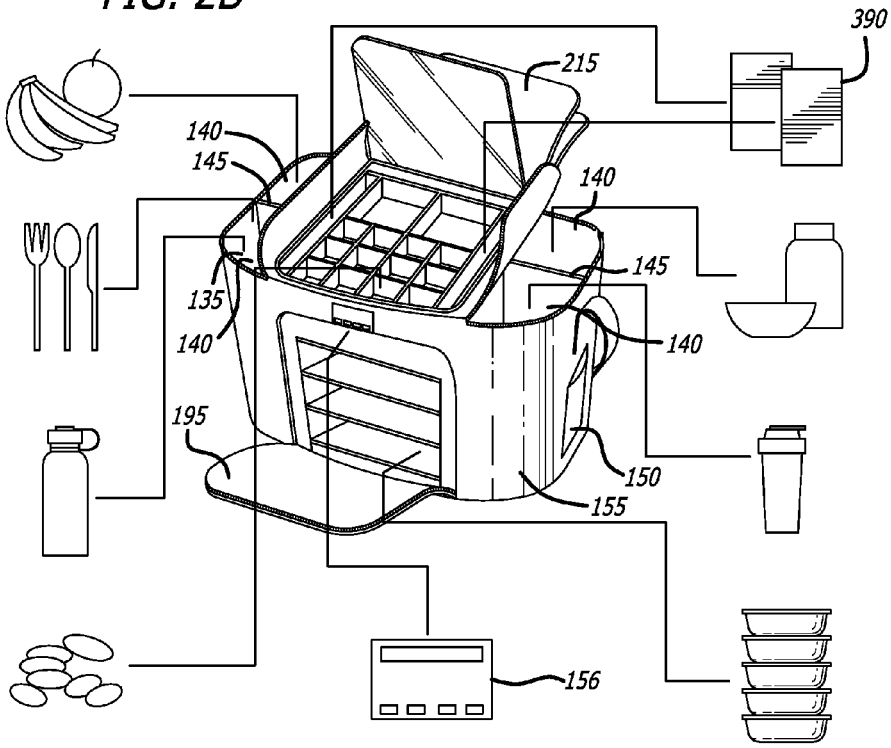
FIG. 2B is a top, front perspective view of a storage assembly similar to FIG. 2A and graphically enhanced with exemplary items, foods, drinks and the like for disposing therein.

As can be seen in FIG. 2A-2B, for convenience and organization, the side compartment cavities 135 may be subdivided into sub-side cavities 140, by way of removable or permanent dividers 145. By way of example, the divider 145 may be removably affixed by vertically aligned, mating hook and loop strips, Velcro® fasteners, or the like. In an embodiment, optionally and as shown, at least one pouch 150 (side pouch as shown) may be located on an external surface 155 of the assembly and having a sealable pouch cavity (not shown) for accommodating objects such as keys, currency, watch, cell phone, and the like.

The assembly 100, on its top 170 (FIGS. 1A and 1B) and front 180 surfaces includes sealable, preferably flexible, top closure flap 190 and front closure flap 195, respectively, for providing a sealingly accessible way to the inner cavity 110 and the shelving structure 115. In an implementation, front closure flap 195 may bring about an "open faced" structure allowing at least substantially unobstructed access to inner storage compartments.

Similarly, the at least one side compartment 130 may be provided with one or more side closure flaps 200 (as shown FIGS. 1A and 2A), may comprise flexible flaps. The top, front, and side closure flaps are designed, to be sealable, for example by way of zipper closures 205. In an embodiment, the flaps provide for independent access to the items, including food containers, which are storable in the storage assembly.

The compartments and flaps are fabricated of a material compatible with, and optionally integral with, the outer shell 105. Such material includes, but is not limited to: nylon, ethylene vinyl acetate ("EVA"), and polyether, just to name a few examples. The flaps may be formed from rigid, flexible, or semi-rigid material to provide the functional and structural integrity necessary to close and open the flaps and provide access to the inner cavity or the side compartment cavities. As seen in FIG. 2B, timer 156 may be included adjacent, such as above, front closure flap 190. In implementations, timer 156 may be useful in alerting the user when food should be removed from compartments, defrosted, allowed to cool, and so forth.

Figure 2C:
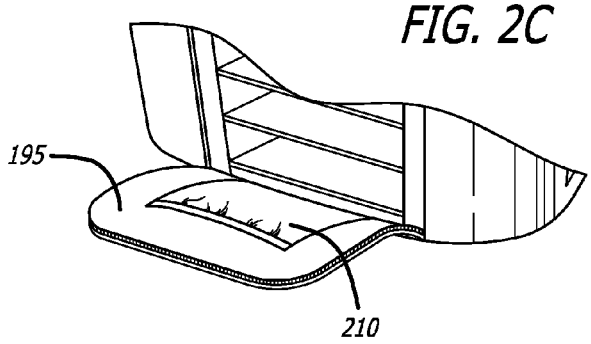
FIG. 2C is a partial front view of a front closure flap of a storage assembly similar to FIG. 2A having an inner compartment for storage of objects.

One or more of the flaps, may be designed to include storage compartments or pouches built into an interior or exterior surface. By way of example, but not limitation, in an embodiment shown in FIG. 2C, the front flap 195 includes an interior front flap pouch 210 for storing additional objects of interest or packets (e.g. ice packets).

In an embodiment, the inner cavity 110, the side compartments 130 and flaps (side, top, or front flaps) are suitably lined on their respective interior surfaces with suitable, preferably padded, layer of an insulating material, such as, for example, EVA and/or other foam materials of sufficient thickness with or without an outer layer of aluminum sheet with polyurethane ("PU") coating. As shown in FIG. 2A, the top flap 190 may be lined with such insulation material layer 215. The padded layer of insulation material, when present, aids in minimizing the release or absorption of unwanted heat to and from interior of the assembly or compartments.

Figure 3A:
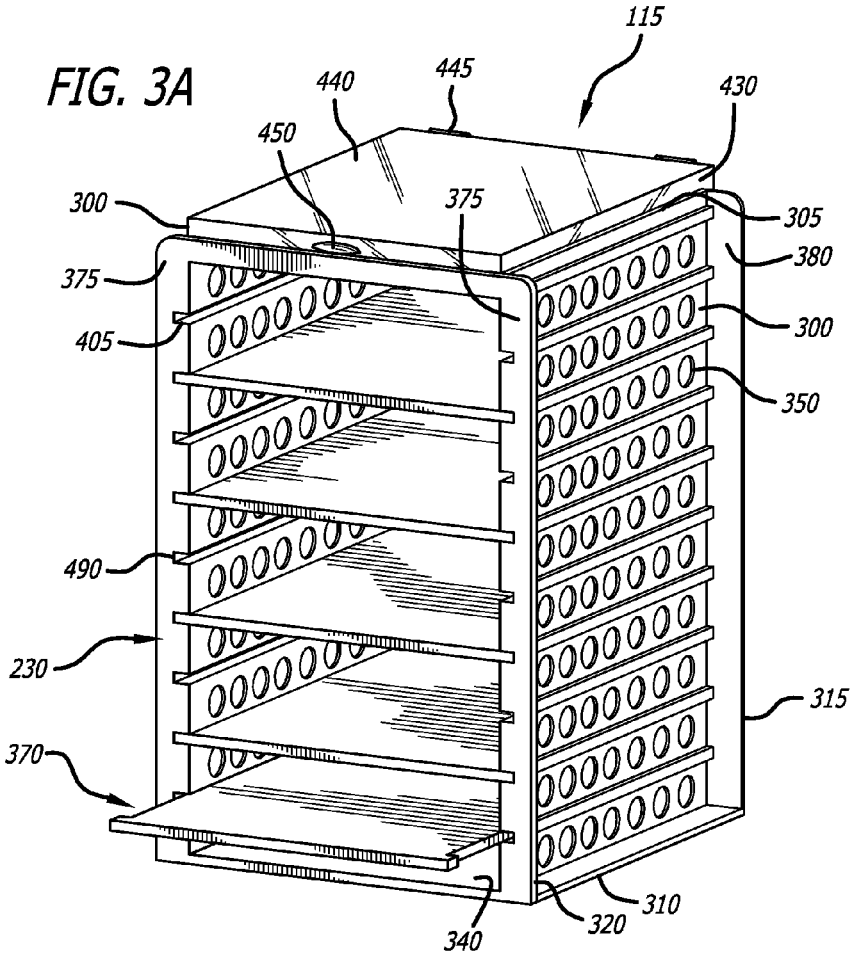
FIG. 3A is a top, front perspective view of a storage assembly rigid structure and upper tray for use in a storage assembly, embodying features of the present invention.
Figure 3B:
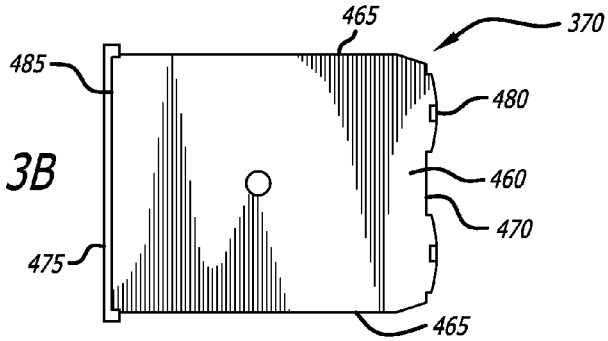
FIG. 3B is a top view of a shelf disposable in the structure of FIG. 3A.

The inner cavity 110, as discussed above is configured to removably receive the shelving structure 115, which may be rigid or substantially rigid and as shown in more details in FIG. 3B, having a structure cavity 230 and as further described in more detail in reference to FIGS. 3A-3B and 4A-4D. The structure and the shelves (370 described below) may be formed from any suitable material, including, but not limited to, plastic, polyvinyl chloride, polyethylene terephtalate glycol, corrugate, rubber, aluminum, or other suitable metals that allow for independent accessibility to storage containers (or other items) storable therein.

Now referring to FIGS. 3A-3B and 4A-4C, in an exemplary embodiment, the shelving structure 115 may be, in at least some implementations, defined by a generally vertically-aligned sidewalls 300, wherein a sidewall may comprise a top 305 and a bottom edge 310, and two side edges, a rear side edge 315 and a front side edge 320; a generally vertically aligned back wall 330 disposed in-between rear side edges of the two side walls 300 (shown in FIG. 4A), and an optional bottom wall 340 disposed in-between the front side edges of the two side walls 300.

In an embodiment and as shown, one or more sidewalls may include apertures 350 extending from an interior surface of side wall 355 to its exterior surface 360. The apertures may enable air to pass or and/or heat transfer to and from the rigid structure cavity 230. The apertures 350 may take on any suitable shape. As shown, the apertures in the side walls have substantially round shapes. The back wall 330 includes back wall apertures or slits 365 which, as shown, have an elongated shape. The back wall slits 365, as will be further described below, enable the engagement of shelves 370 with the structure's back wall.

In an embodiment, and as shown in FIG. 3A, side wall 300 rear and front edges 315 and 320 include extensions 375 and 380, which may extend perpendicularly (as compared to the surface of the sidewalls) from the front and back edges of the side walls. The extensions 375 and 380 may create recesses 385 for removably receiving temperature modification material or packets 390 (shown in FIG. 2B). In the embodiment shown, the side wall extension on the back edge of a side wall is formed integral with the back wall 330, or in other words, the width of the back wall 330 is sufficiently dimensioned as to extend beyond the main frame 400 of the structure. As can be appreciated, the packets 390 disposable within recesses 385 may be a single packet or a plurality of individual separate packets. The packets may be vertically or horizontally aligned and or stacked in the recesses.

In the implementation of FIG. 3A, an inside surface of the shelving structure 115, may comprise a plurality of guiding tracks 405 which may be integrally formed with the inside surface of a side wall and configured for receiving at least one shelf 370. Guiding tracks may be disposed on both the side walls with guiding track on aside wall substantially extending parallel to a matching guiding track on the opposite side wall, thus forming a paired set of guide tracks. As shown, apertures 350 formed in the side walls may be grouped in rows 410 extending from the front to the back end of aside wall, wherein the rows may be vertically spaced apart from each other. In the embodiment shown, the guiding tracks may be formed in between the rows of side wall apertures. The shelves may be formed from any suitable material, including, but not limited to, hard plastic, EVA, aluminum, and/or other rigid materials.

The shelving structure 115 may be further provided with an optional top wall 415 disposed opposite an optional bottom wall 340 and extending between two side walls. A top wall may be integral with the structure or be removably disposable thereon. When removably disposable, the top wall may be removably securable to the structure by any suitable means, including snap and fit. In an embodiment in which a top tray is a removable top tray, top wall 415 may facilitate easy access to interior cavity 230 of the shelving structure 115 from above.

The shelving structure 115, in the embodiment shown in FIG. 3A, includes a top tray 430 disposed on the top wall 415. The top wall 415 (see FIG. 4B) and the tray 430 may be integrally formed with one another or alternatively, the tray may be removably disposable on the top wall. As shown, the top wall 415 and the top tray 430 may be integrally formed with one another as well as being integrally formed with the shelving structure 115.

Figure 4A:
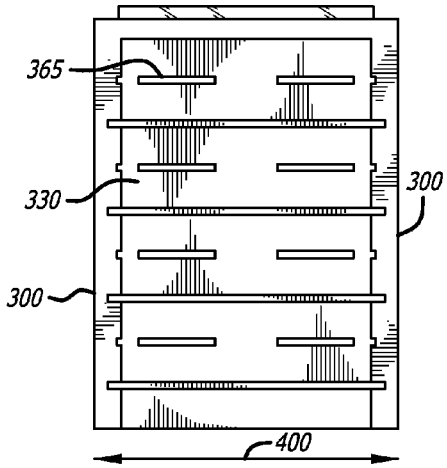
FIG. 4A is a rear elevation view of the storage assembly rigid structure of FIG. 3A.
Figure 4B:
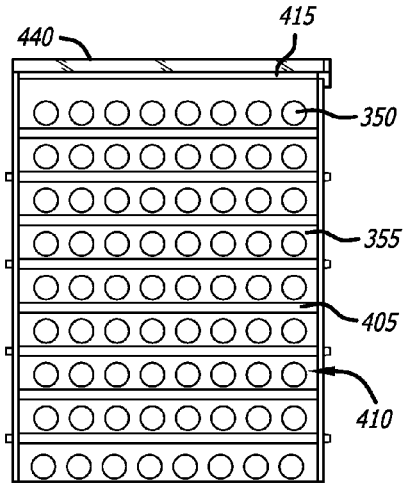
FIG. 4B is a first side elevation view of the storage assembly rigid structure of FIG. 3A.
Figure 4C:
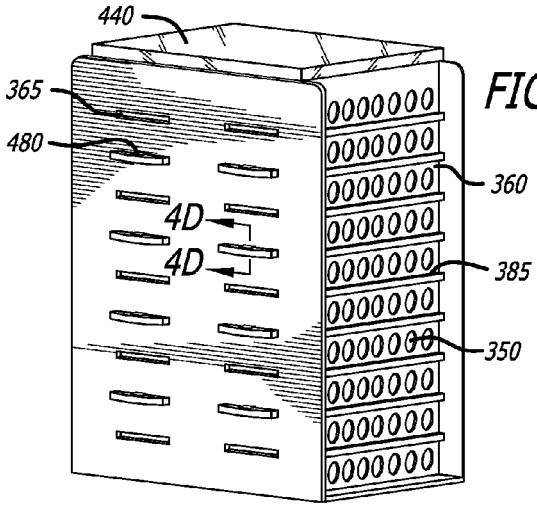
FIG. 4C is top back side, perspective view of the storage assembly rigid structure of FIG. 3A with the shelves engaged therein.
Figure 4D:
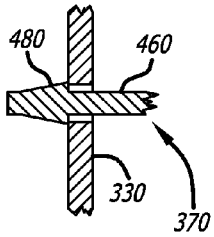
FIG. 4D is an enlarged cross-sectional view taken along line 4D in FIG. 4C.

As shown in FIGS. 3A and 4A-4C, a tray cover 440 is disposed on the top surface of the top tray. The tray cover 440 is secured to the top tray by suitable mechanisms such as hinges 445 which are disposed at the back wall 330 and form a secure enclosure for housing various items (e.g., nutritional supplements, personal effects) in the top tray by way of a snap-fit design. The tray cover at the front, as shown in FIGS. 3A and 4C, includes a thumb-grip 450 for easy snapping off and on of the tray cover from the tray itself. Alternatively the tray cover may be secured to the top tray by way of a snap-fit or any other suitable means, without the thumb-grip.

Shelves 370 may be designed to be removably slidable in the guiding tracks 405 (shown in FIG. 3A) within the interior cavity 230 of the structure. Shelves, once disposed in the cavity 230, may be removably and slidably engaged on two sides to the two side walls of the structure and extends to the back wall. As further shown in FIG. 3B, the shelf includes a horizontal surface 460 which is bound by four edges: two side edges 465, a back edge 470, and a front edge 475. Width of the shelf may extend between the two side edges and may be of sufficient dimension so as to slidably engage the guiding tracks 405 which are formed in the interior surface of the shelving structure 115. The shelf 370 at a back edge 470 includes one or more tabs 480, each tab including on either side (top or bottom surface of the shelf) a notch which engages with the slits 365 which are formed in the back wall of the structure. As can be seen in FIG. 3B, the shelf is designed to be reversible such that the user does not have to be concerned with which side has to face up or down as the shelf is slid into the guiding tracks. Of course, as can be appreciated, this reversibility in design is optional.

In operation, the notches in the tabs, once engaged with the slits, provide a stop so as to minimize unwanted sliding of the shelves out of the structure. In an embodiment as shown in FIG. 3B the front edge of the shelf includes a lip 485 on either side of the tray's front edge. In operation, the lips 485 engage with stop apertures 490 formed in the side wall extensions 375 of the shelving structure 115. The stop apertures are designed so as to be substantially perpendicular to the longitudinal direction of the guiding tracks, and to aid in the securing of the shelves once a shelf has been slid inside the structure cavity. In operation, once the shelf has slid all the way through to the end of the back wall and has engaged therewith (e.g., by way of the tabs), the engagement of the lips with the stop apertures further secures the shelf in the structure. In an embodiment, the stop apertures may be formed integral with the side walls (e.g., without the need to be present in the extension).

As can be noted and as shown in FIG. 1A, the one or more shelves may be modularly disposable in the inner cavity of the structure so as to accommodate the number and the height of a given container 120 (e.g., food container). By way of example, when a given shelving structure 115 has the capacity to receive five, for example, different shelves (and containers thereon), the user may choose not to use all the trays so as to place a taller container in the structure.

The shelves 370 are shaped and designed to hold thereon containers, such as meal containers 120. The meal containers can be of any suitable design and material. By way of example, such containers may be formed from material that can withstand being exposed to a range of temperatures as a result of being exposed to oven, stove, microwave, refrigerator, freezer, ambient, and the like. The containers may simply be placed on the trays and may be stored at room temperature (depending on the food item requirements) or may be preheated or pre-chilled. If the user wishes to maintain the temperature of the contents of the containers at a desired temperature, the packets 390 (See FIG. 2B) may be disposed adjacent the containers to help maintain the desired temperature and minimize heat loss or gain.

Figure 5A:
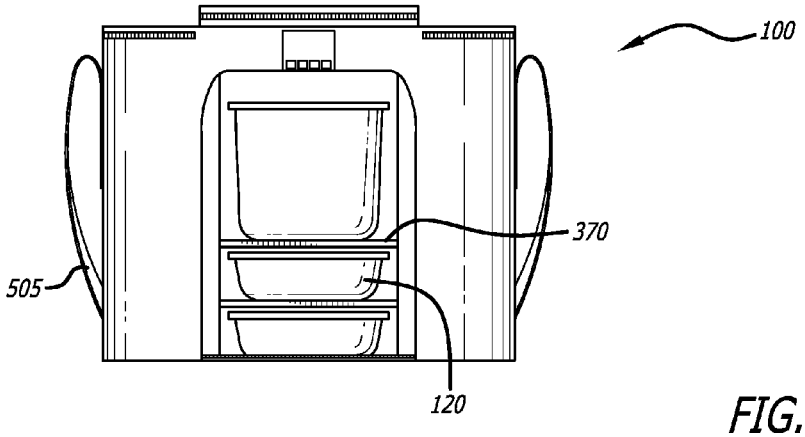
FIGS. 5A and 5B are front elevation views of a storage assembly essentially similar to that shown in FIG. 1B, and illustrating the variety of food containers optionally accommodated therein.
Figure 5B:
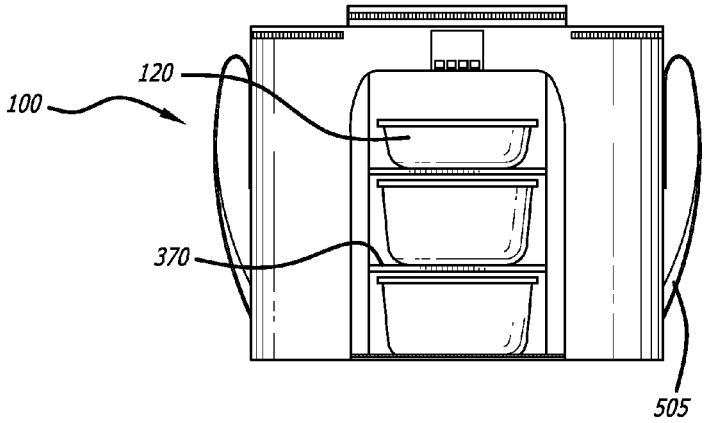

FIGS. 5A and 5B illustrate front elevation views of other assemblies 100 similar to the assembly 100 of FIG. 1A with the exception that only two shelves 370 are disposed in the shelving structure 115 and variably spaced in a vertical array to accommodate differing sized meal containers 120.

Figure 6A:
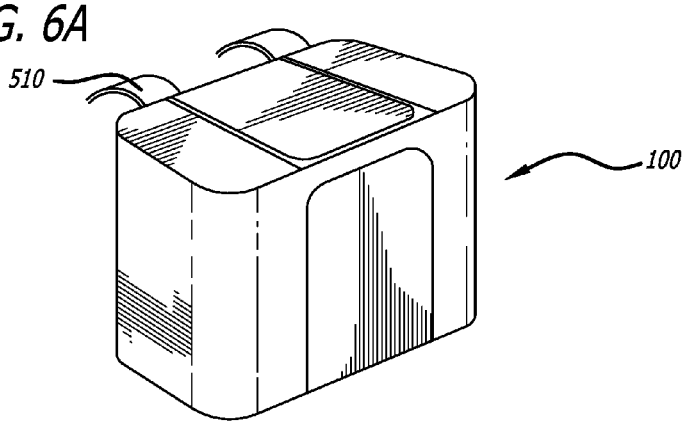
FIG. 6A is a front elevation view of a storage assembly embodying features of the present invention and optionally provided with shoulder mount straps for transport.
Figure 6B:
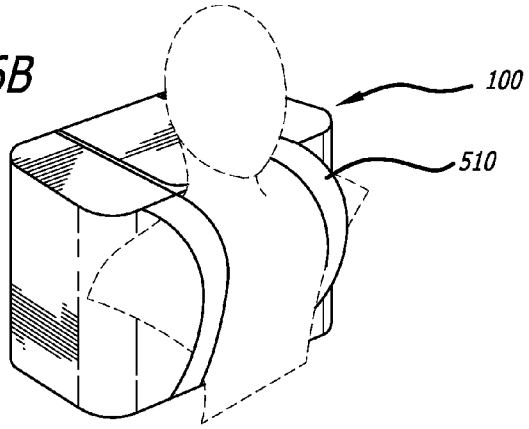
FIG. 6B is front elevation view of the storage assembly of FIG. 6A carried on a person's body.
Figure 6C:
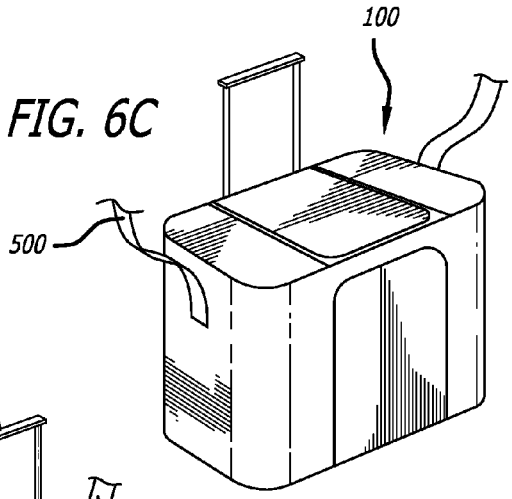
FIG. 6C is a front elevation view of a storage assembly embodying features of the present invention and optionally provided with transporting handles.
Figure 6D:
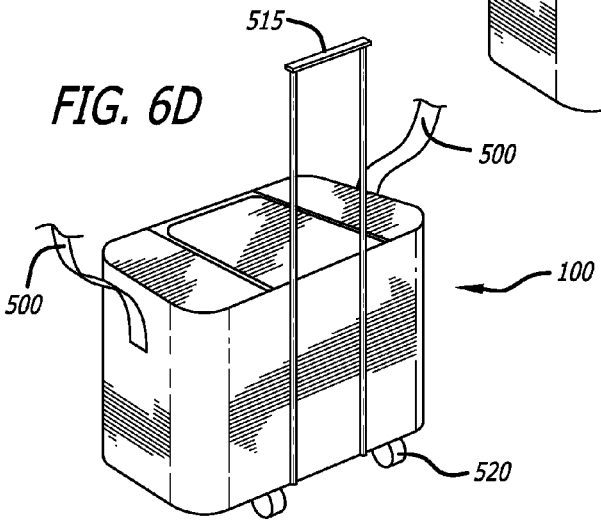
FIG. 6D is a rear elevation view of the storage assembly of FIG. 6C.

The assembly 100 as can be seen in FIGS. 1A-1B, 5A-5B, and 6A-6D, may be configured for transportability by any suitable means, including, but not limited to, one or more top handle 500 secured to the top flap 190 (FIG. 1A), a shoulder strap 505 (FIG. 5A), harness shoulder straps 510 (FIGS. 6A-6B) for being worn on the user's back, and a pull out handle 515 (FIG. 6D) secured to the back of the assembly for being pulled by the user. As shown in FIG. 6D, the assembly further includes one or more wheels 520 for ease of transportation when the assembly is being pulled by the user. As can be appreciated, the handle may be placed on the side, as opposed, or in addition to the back of the assembly, for easy of navigation in different pathways having different widths (e.g., airplane aisle).

Now referring to FIGS. 7A-7F, embodying features of the present invention, the assembly includes a rigid structure 600 formed from a plurality of shelves 605, and configured to receive a top enclosable top tray 430' disposable on the top surface structure. As shown, the structure 600 is disposable into an inner assembly cavity 110' either from above through the top opening 610 or from the front through a front opening 615. The plurality of the shelves may be permanently or removably affixable to one another.

Figure 7A:
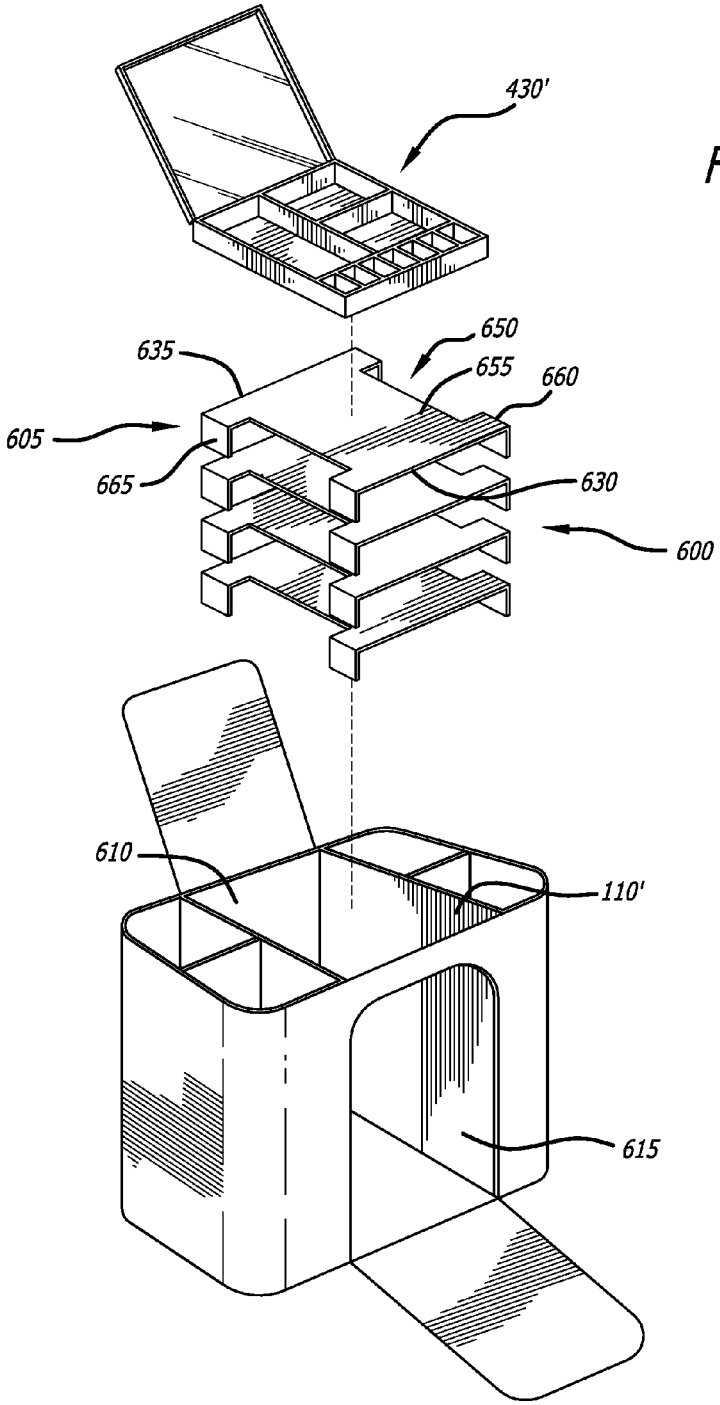
FIG. 7A is a top, perspective exploded view of a storage assembly embodying features of the present invention showing at least some of its various components.
Figure 7F:
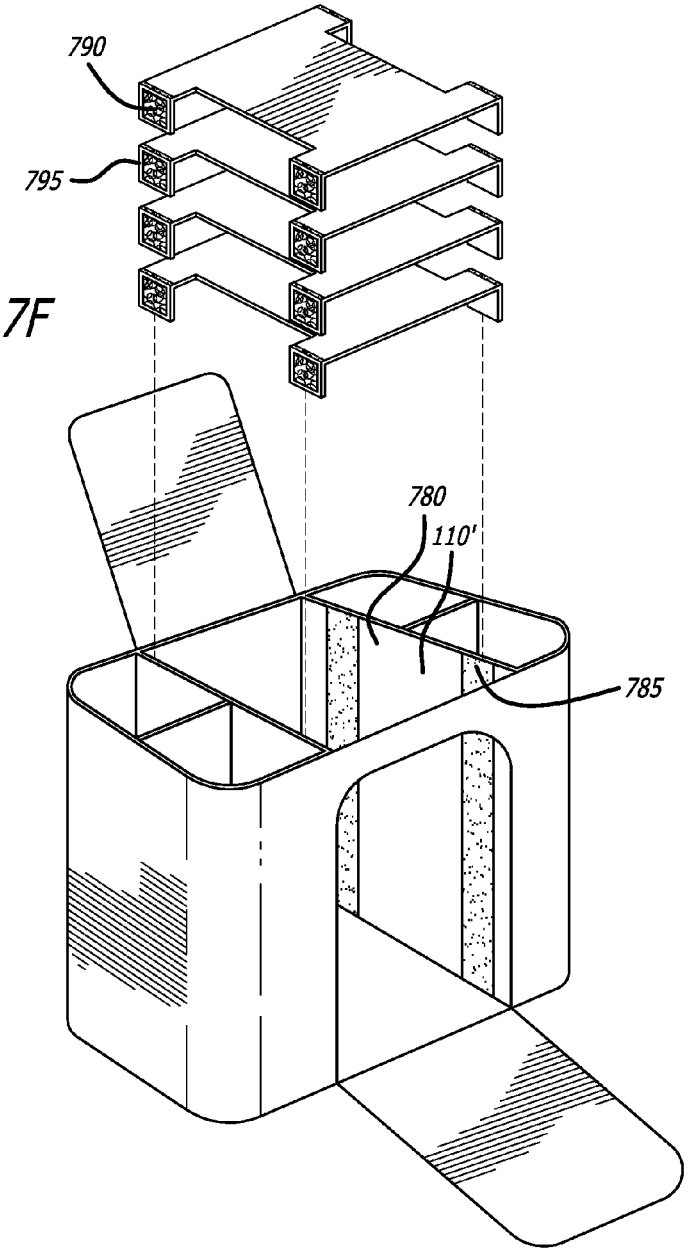
FIG. 7F is an enlarged partially cut away side view of an embodiment of stackable shelves of FIG. 7B being removably disposed on one another and further removably securable to the interior of the assembly by way of suitable mechanisms such as Velcro® design.

The structure 600, as shown, includes a plurality of stackable shelves 605. One or more stackable shelves 605, as shown in FIG. 7B, has top and bottom surfaces, 620 and 625; and a front, a rear, and two side edges; 630, 635, 640, 645, respectively. The shelf has a main rectangular surface 650 which is narrower in its center region 655 and wider toward the front and back edges by way of shelf-edge portions or extension 660 which are integrally formed with the rest of the shelf, forming an overall "capital I" shaped shelf surface. The extensions at their side edges include a rigid projection (or "leg") 665 disposed in a substantially perpendicular arrangement to the surface of the shelf. In operation, the shelves can be stacked upon each other and spaced apart from one another by a distance equal to the height 670 of a rigid leg. The shelves may comprise the same or different heights as determined by the height of the rigid legs. In use, the user may stack different shelves having legs of different dimensions in order to accommodate different type of containers in the storage assembly. As shown in FIG. 7A, the top tray 430' is removably disposable on the top surface 620 of the upper most shelf 675A. In an embodiment, the legs may be removably attachable to another shelf, such that a given shelf may receive legs of the same or different lengths. In this configuration, a consumer may purchase a set number of shelves with a plurality of legs of varying lengths.

In some embodiments, and as shown in FIGS. 7C and 7D, and FIGS. 7C and 7E, stackable shelves 700 and 750 may be further removably secured to one another, by way of securing elements. In the embodiment shown in FIGS. 7C and 7D, the securing element 705 comprises a Velcro® type securing element. In the embodiment shown, the Velcro® surface 707 is disposed on the bottom surface 710 of leg 715 to removably engage with a corresponding Velcro® surface 720 disposed on a corresponding top surface 725 of an opposing shelf.

In the embodiment shown in FIGS. 7C and 7E, the securing element comprises a snap and fit element 755. In the embodiment shown, the snap and fit element includes a knob 760 disposed on (or integral with) the bottom surface 765 of leg 770 to removably engage with a corresponding detent 775 disposed on a corresponding top surface of an opposing shelf. As can be appreciated by those skilled in the art, other suitable securing elements are also within the scope of the present invention.

In the embodiment shown in 7F, the inner surface 780 of the inner cavity 110' may be equipped with fasteners 785, such as Velcro® design, which can removably engage a corresponding Velcro® surface 790 on legs 795. In this configuration, the legs are further secured to minimize unwanted movement.

In another embodiment shown in FIG. 7G, a structure 800 is shown having a series of stackable shelves 810. The distance (height) 815 between the various shelves is adjustable. One or more bellowed-legs 820 connect a lower surface 830 of an upper shelf leg 835 to an upper surface 840 of a shelf which is disposed immediately below the upper shelf. The distance between the various shelves is adjustable as bellowed-legs are pulled up or pushed down to lengthen or shorten their height, thus adjusting the distance between two vertically adjacent shelves. In the embodiment shown in FIG. 7H, a bottom 870 of a bellowed-leg includes a tab 875 for removably being inserted into a groove 880 (snap and fit), thus removably securing the upper and lower shelves with one another.

In an embodiment, the bellowed leg of an upper shelf may be permanently attached to an upper surface of an immediately lower shelf. In this configuration, the distance between the various shelves is still adjustable by moving the bellowed legs up or down (e.g., stretching or compressing the legs).

In the embodiment shown, the structure 800 has five shelves. The most bottom shelf 905 is spaced apart, by a distance A, from shelf 910 which is immediately disposed above the most bottom shelf 905. The second 910 and third 915 shelves (counted from the bottom) are disposed next to one another and separated by a distance B which is different than A. In an embodiment, adjacent shelves may effectively have no usable space therebetween to allow for greater separation between other adjacent shelves to allow for containers of various heights. The adjustable distances between the various shelves enables the user to place containers of various heights on the various shelves.

Figure 8A:
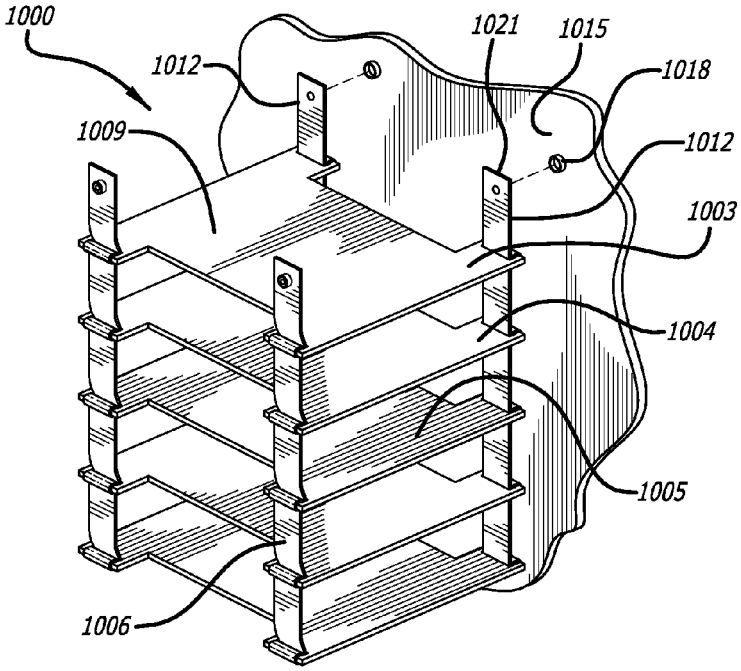
FIG. 8A is a perspective view of a shelving system embodying features of the present invention and having been exploded off a fragmented interior wall of the storage assembly.
Figure 8B:
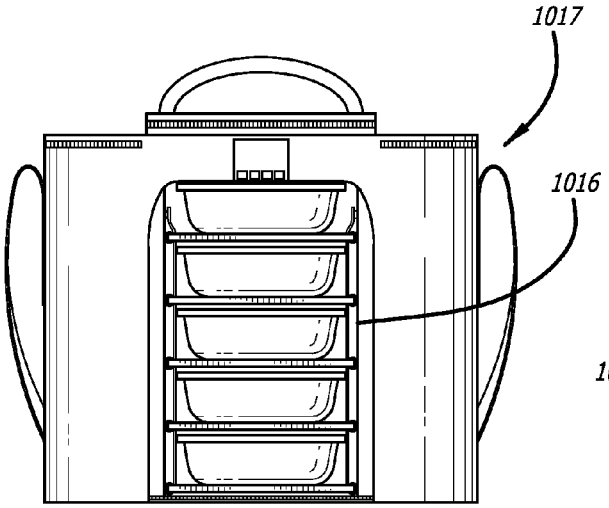
FIG. 8B shows a front elevation of a storage assembly with the shelving system of FIG. 8A disposed therein.
Figure 8C:
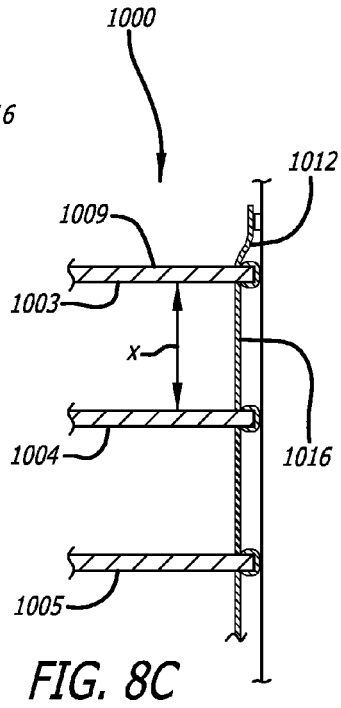
FIG. 8C is a sectional view of the shelving system of FIG. 8A attached to an interior wall of the storage assembly and having collapsible strips connecting the shelves with one another.

Now referring to FIG. 8A, a shelving structure 1000 is shown including a plurality of shelves 1003. The shelves are connected to one another by way of flexible strips 1006 formed from flexible material such as fabric. The upper shelf 1009 further includes an attachment strip 1012. An inner surface 1015 of an inner cavity 1016 (see FIG. 8B) of a storage assembly 1017 (see FIG. 8C) may be equipped with fastener 1018, such as Velcro® design, snap and fit, or buttons (as shown), or the like which can removably engage a corresponding Velcro® surface, snap and fit, or button 1021 on the flexible strip 1006. In this embodiment, the flexible strip has a collapsed and an expanded dimension. The flexible strips allow for compact storage of the shelving structure if needed. In use, the flexibility of the fabric allows for containers of different height to be placed on the various shelves. The maximum height of the shelving structure in expanded configuration, as shown in FIG. 8C, is substantially equal to the sum of the length of the various strips in their expanded state.

Figure 8D:
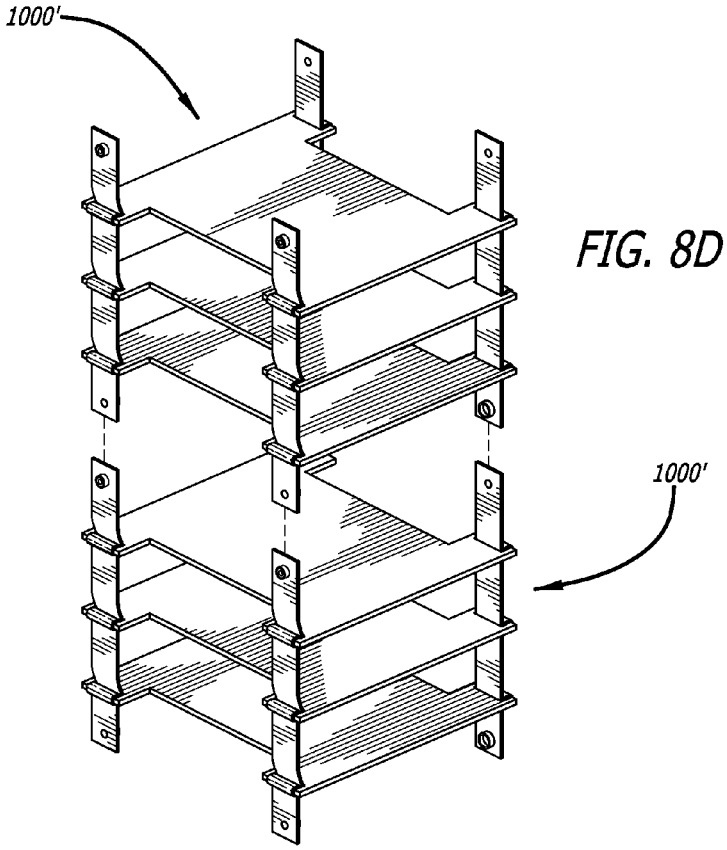
FIG. 8D is a perspective view of two shelving systems embodying features of the shelving system of FIG. 8A in operation with one another.

As shown in FIG. 8D, more than one shelving structure may be used with one another in a single storage assembly (as those described earlier).

Figure 8E:
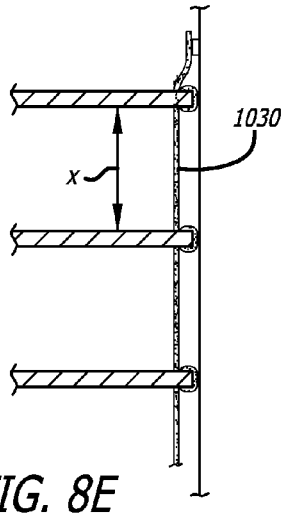
FIG. 8E is a shelving system similar to that in FIG. 8A and having collapsible elastic legs.
Figure 8F:
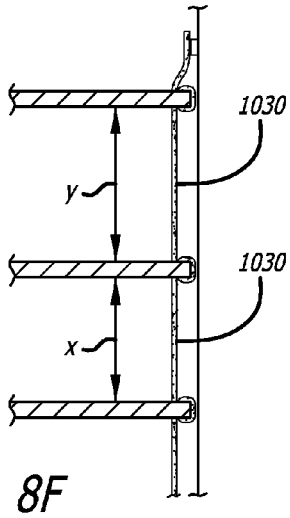
FIG. 8F shows the shelving system of FIG. 8E having at least one of the elastic legs with different in-use dimensions than at least one another.

In an embodiment shown in FIG. 8E, a storage assembly 1000', similar to that shown in FIGS. 8A-8D is shown, having an elastic strip 1030 used instead of flexible strip 1006 which may be affixed to shelves 1003, 1004, and 1005, for example. In this embodiment, the strip 1030 has a base dimension X similar to the embodiment of FIGS. 8A-8D. When a container is placed on the shelf 1004 (FIG. 8C), the elastic dimension may increase to dimension Y which is greater than X. In this manner, the storage assembly may accommodate various sizes of containers in which a container having a greater height may stretch the elastic strip.

The foregoing disclosure of the exemplary embodiments has been presented for purposes of illustration and description. It is not intended to be exhaustive or to limit the invention to the precise forms disclosed. Many variations and modifications of the embodiments described herein will be apparent to one of ordinary skill in the art in light of the above disclosure.

Further, in describing representative embodiments, the specification may have presented methods and/or processes as a particular sequence of steps. However, to the extent that the methods or processes do not rely on the particular order of steps set forth herein, the methods or processes should not be limited to the particular sequence of steps described. As one of ordinary skill in the art would appreciate, other sequences of steps may be possible. Therefore, the particular order of the steps set forth in the specification should not be construed as limitations on the claims.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the scope of the appended claims. In one example, a storage assembly may implemented as a backpack and/or briefcase in which a laptop, tablet, clothing, shoes, business essentials accessories, a wire or mesh organizational compartment and other travel essentials may be included.

What is claimed is:

1. A portable storage assembly for removably storing objects therein, comprising:

an inner cavity having at least two side walls and made from a thermal insulating material;

an inner housing disposed within the inner cavity, the inner housing including a plurality of strips fastened near a corner portion of a plurality of horizontal shelves so as to suspend one or more of the plurality of horizontal shelves from the at least two side walls, each corner of the plurality of horizontal shelves being suspended along a substantially vertical line beneath a fastener, each fastener being connectable to one of the at least two side walls; and a thermally insulated front access to the inner housing.

2. The portable storage assembly of claim 1, wherein the thermally insulated front access comprises a closure flap formed from an insulating material, the closure flap enabling access to the inner cavity.

3. The portable storage assembly of claim 1, wherein the plurality of strips comprise a flexible material.

4. The portable storage assembly of claim 1, wherein the plurality of strips comprise a flexible elastic material.

5. The portable storage assembly of claim 1, wherein one or more of the plurality of strips is fastened to the thermal insulating material using hook and loop fasteners, one or more snaps, one or more buttons, or any combination thereof.

6. The portable storage assembly of claim 1, further comprising at least one side cavity adjacent the inner housing.

7. The portable storage assembly of claim 1, further comprising a top tray disposed above the plurality of horizontal shelves and covered by a thermally insulating material.

8. A portable storage assembly for removably storing objects therein, comprising:

an inner cavity bound by a thermal insulating material;

an inner housing disposed within the inner cavity, the inner housing including a plurality of strips that affix to a plurality of horizontal shelves and to the thermal insulating material, each corner of the plurality of horizontal shelves being suspended along a substantially vertical line beneath a fastener, each fastener being connectable to the insulating material, the insulating material being fastened to, or integrated with, the at least one side wall forming the inner cavity; and a thermally insulated front access to the inner housing.

9. The portable storage assembly of claim 8, wherein the plurality of strips comprises four strips, wherein each of the four strips affixes to a corner portion of each of the plurality of horizontal shelves.

10. The portable storage assembly of claim 8, wherein the plurality of strips comprise sufficient flexibility to accommodate meal containers of differing heights.

11. The portable storage assembly of claim 8, wherein one or more of the plurality of strips is fastened to the thermal insulating material using hook and loop fasteners, one or more snaps, one or more buttons, or any combination thereof.

12. The portable storage assembly of claim 8, further comprising at least one side cavity adjacent the inner housing.

13. The portable storage assembly of claim 8, further comprising a top tray disposed above the plurality of horizontal shelves.

14. The portable storage assembly of claim 13, wherein the top tray is covered by a thermally insulating material.

15. A portable storage assembly for removably storing objects therein, comprising:

a housing formed from insulating material and including an inner wall forming an inner cavity;

a plurality of strips affixed to a plurality of shelves horizontally disposable within the inner cavity, the plurality of strips configured to fasten the plurality of shelves to the inner wall, each corner of the plurality of horizontal shelves being suspended along a substantially vertical line beneath a fastener, each fastener being connectable to the insulating material for fastening the plurality of strips to the inner wall; and a thermally insulated front access to the inner housing.

16. The portable storage assembly of claim 15, wherein the plurality of strips includes second portions of the fastener assembly for mating with corresponding first portions of the plurality of the fastener assemblies.

17. The portable storage assembly of claim 16 wherein the fastener assemblies comprises a hook and loop fastener, one or more snaps, one or more buttons, and any combination thereof.

18. The portable storage assembly of claim 16, wherein at least one of the plurality of strips is fastened near a corner portion of at least one of the plurality of the shelves.

19. The portable storage assembly of claim 16, wherein the plurality of strips are configured to suspend one or more of the plurality of shelves from the inner walls of the housing.

* * * * *